United States Patent [19]

Hendrickson

[11] 4,004,641

[45] Jan. 25, 1977

[54] MOTOR GRADER DRAWBAR ASSEMBLY WITH SAFETY CLUTCH MECHANISM

[75] Inventor: Vergil P. Hendrickson, Morton, Ill.

[73] Assignee: Caterpillar Tractor Co., Peoria, Ill.

[22] Filed: Feb. 24, 1975

[21] Appl. No.: 551,931

[52] U.S. Cl. ..... 172/781; 37/42 VL; 64/30 R; 172/103; 172/261; 172/793; 172/796

[51] Int. Cl.[2] ..... E02F 3/76; A01B 61/04

[58] Field of Search ..... 172/103, 261, 533, 789, 172/790, 791, 792, 793, 795, 796, 797; 37/42 VL, 43 K; 64/30 R, 30 C, 30 LB; 192/56 R, 56 L, 113 B

[56] References Cited

UNITED STATES PATENTS

| | | | |
|---|---|---|---|
| 2,655,015 | 10/1953 | Linder | 64/30 C |
| 2,708,836 | 5/1955 | Stuart | 64/30 R |
| 2,733,798 | 2/1956 | Almen et al. | 192/113 B |
| 2,760,285 | 8/1956 | Greeley | 172/795 |
| 2,943,466 | 7/1960 | Elliott | 64/30 C |
| 3,025,686 | 3/1962 | Lewis | 64/30 R |
| 3,406,583 | 10/1968 | Baier | 64/30 R X |
| 3,712,384 | 1/1973 | Fisher | 172/796 |
| 3,775,998 | 12/1973 | Century et al. | 64/30 C X |
| 3,797,621 | 3/1974 | James | 192/56 |

*Primary Examiner*—Richard T. Stouffer
*Attorney, Agent, or Firm*—Robert E. Muir

[57] ABSTRACT

The motor grader drawbar assembly has a blade mounted on a circle gear and a drive gear selectively rotates the circle gear and the blade via a pinion gear engaged with the circle gear and mounted on a rotatable shaft. A slip clutch is interposed between the drive gear and the shaft to allow relative movement therebetween when a preselected torque is exceeded, as when the blade hits an obstruction. A pressure plate overlies the slip clutch and may be adjusted to change the preselected torque required.

10 Claims, 3 Drawing Figures

Fig. 1.
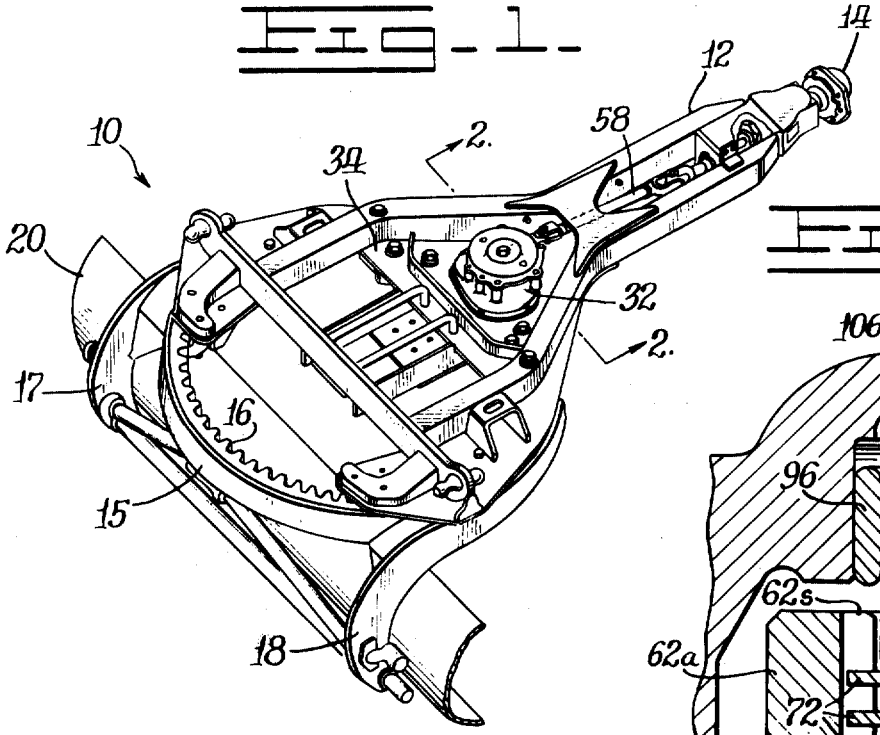
Fig. 3.
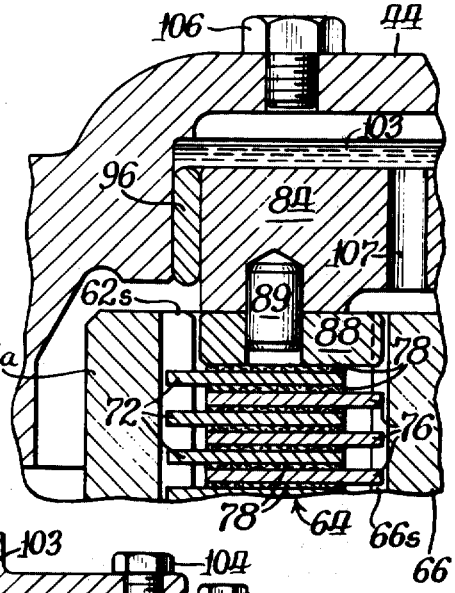
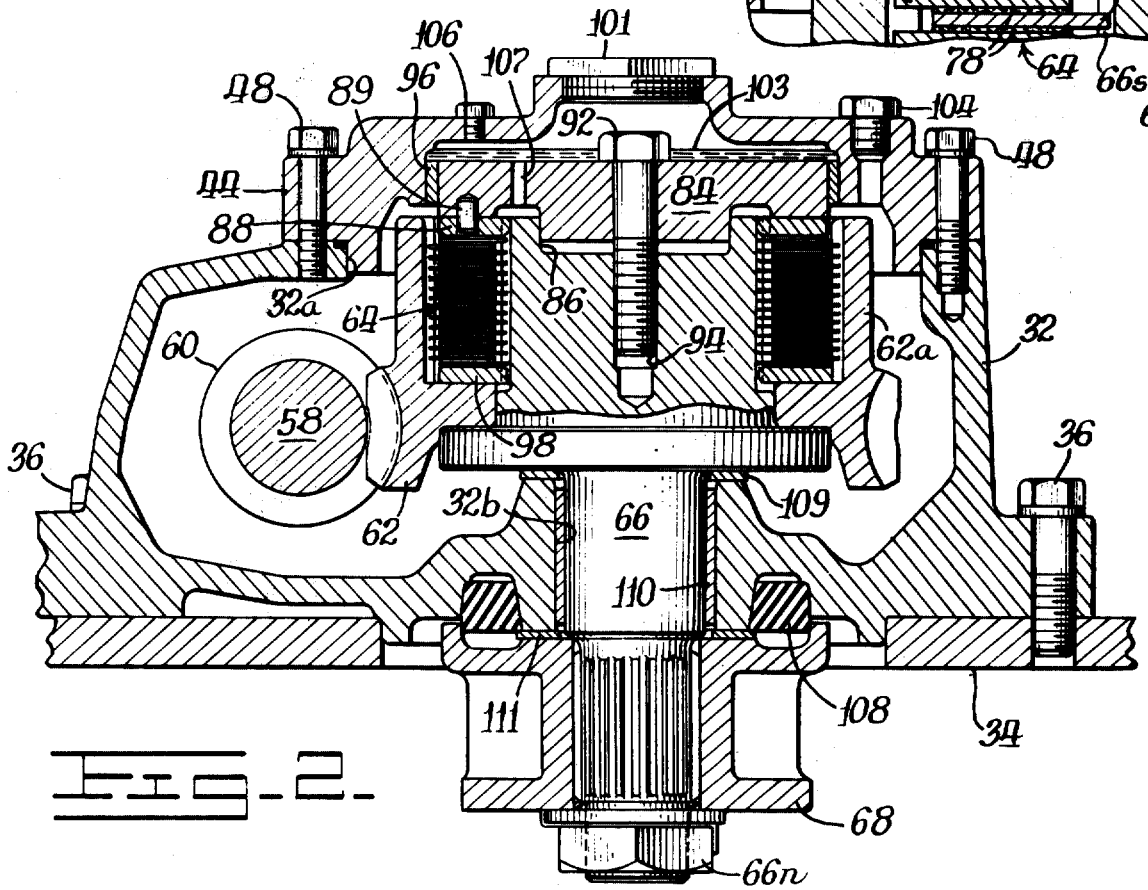
Fig. 2.

MOTOR GRADER DRAWBAR ASSEMBLY WITH SAFETY CLUTCH MECHANISM

BACKGROUND

The invention pertains generally to earthworking equipment and more particularly to such equipment having a scraper between the front and rear ground supports of the vehicle, e.g., a motor grader.

As is known by those versed in the art of motor grader operations, the blade member can sometimes strike an unseen obstruction. One example is when the motor grader is removing snow at relatively high speed on a highway and the blade member strikes a raised manhole cover. This is known to cause a high degree of impact on the blade, sometimes causing fracture of the circle drive mechanism members. If the motor grader is being operated at a carelessly high rate of speed, such fracturing can cause the blade member to "free-wheel" into one of the vehicle tires, with subsequent damage to the blade and the tires. It is desirable to provide some mechanism which would allow some slippage or relative movement of the blade when such an impact occurs.

SUMMARY

The present invention relates to motor graders and, more particularly, to a motor grader drawbar assembly having a safety clutch mechanism associated with the drive apparatus.

It is the general object of the present invention to provide a motor grader drawbar assembly which overcomes the problem of breakage on high impact on the blade.

Another object is to provide a drawbar assembly in which the drive mechanism is associated with a safety clutch mechanism which permits relative movement between the blade and the drive mechanism.

Still another object of the present invention is to provide a drawbar assembly in accordance with the foregoing object in which the torque at which the relative movement occurs may be selectively adjustable.

It is another object to provide a drawbar assembly in accordance with the foregoing objects which has a slip clutch of simplified and economic construction.

Still another object is to provide a safety clutch mechanism which may be incorported in existing drawbar assemblies, which may be easily installed and removed, or which may be readily disassembled for replacing parts or varying the number of clutch plates.

These, and other objects and advantages of the present invention, will become apparent as the same becomes better understood from the following detailed description when taken in conjunction with the accompanying drawings.

DRAWINGS

FIG. 1 is a perspective view of a motor grader drawbar assembly incorporating the present invention;

FIG. 2 is a cross sectional view through the safety clutch mechanism taken generally along line II—II of FIG. 1; and FIG. 3 is a fragmentary sectional view, on a larger scale than FIG. 2, and illustrating the interleaved elements of the slip clutch in greater detail.

DESCRIPTION

Reference is now made more particularly to the drawings which illustrate the best presently known mode of carrying out the invention and wherein similar reference characters indicate the same parts throughout the several views.

A drawbar assembly, generally designated 10 in FIG. 1, includes a Y-shaped drawbar frame 12 having a ball 14 at its forward end for pivotal connection to a motor grader or similar earthworking machine (not shown). As is usual, a circle 15 is rotatably mounted on the frame 12 and carries a pair of spaced supports 17 and 18 on which a moldboard or blade 20 is mounted. Preferably, the blade 20 may be both tilted and shifted laterally relative to the circle 15. The mechanism for accomplishing such movement is well known in the art and hence is not shown or described herein. The circle 15 has a plurality of teeth 16 on the inner surface to provide a means by which the circle may be rotated. Hence, the circle 15 is sometimes referred to as a circle gear or a ring gear. It will be understood that the blade and the circle are interrelated so that the blade 20 revolves as the circle 15 rotates.

FIG. 2 is an enlarged cross sectional view illustrating structure in greater detail. A housing 32 is mounted on an apron 34 extending between the legs of the frame 12, by means of a plurality of bolts 36. The housing 32 sealingly encloses the circle drive members which are hereinafter described in detail. A housing cover member 44 is sealingly attached to the upper end of the housing 32 as by a plurality of bolts 48. A drive shaft 58 delivers power into the housing 32 to a worm 60 that threadably engages a worm gear 62. The worm gear transmits power by means of a slip clutch assembly 64 to an upright shaft 66 that is splined to a pinion gear 68 meshed with the circle teeth 16. As can be seen, the housing 32 has aligned upper bore **32*a* and a lower bore 32*b* through which shaft 66** extends.

As can be seen in FIG. 2, worm gear 62 has an upwardly extending flange **62*a* which is spaced from the periphery of the upper end of shaft 66 to form an annular cavity therebetween. Shaft 66 has a plurality of external splines such as shown at 66*s* in FIG. 3. Similarly, worm gear 62 has a plurality of internal splines 62*s*. The slip clutch 64 includes a plurality of thin, flat, annular discs 72 splined to the worm gear 62. Between each two discs or washers 72, are similar discs 76 splined to the shaft 66. In between the discs 72 and 76 is a friction disc 78. Each friction disc 78 is preferably bonded to one of the adjacent discs 72 or 76. The friction discs 78** are advantageously of the "paper" family of a type having an extremely high static friction level. Typical dynamic friction is 0.11 to 0.12. The static friction level ranges between 0.12 and 0.17 in SAE 30 oil. One suitable material is Raybestos-Manhattan R3681-22 sold by Raybestos-Manhattan, Inc. of Bridgeport, Conn.

It will be noted that the cover plate 44, when removed, provides access to the clutch cavity so that the various discs may be removed and replaced when necessary. Also, additional discs may be added to the stack to increase the torque between the worm gear 62 and shaft 66, or vice versa. By removing a nut **66*n* at the bottom of shaft 66, the pinion gear 68 can be separated from the shaft. This permits the removal and replacement of the shaft 66, worm gear 62, slip clutch assembly 64**, and attendant parts as a unit.

Means is provided for applying an adjustable compressive force on the interleaved discs or elements and, in the preferred embodiment shown, this is accomplished by a clutch adjustment plate or pressure plate 84 which is piloted in a recess 86 at the upper end of the shaft 66, and is locked to the shaft 66 by means of a hardened washer 88 that is splined to the shaft 66 and doweled to the plate 84 via pin 89 (see FIG. 3). Washer 88 abuts the uppermost disc 78 and the pressure which it applies to the interleaved discs is variable by means of adjusting bolt 92 which passes through an opening in plate 84 and is threaded into an axial hole 94 in the upper end of shaft 66. A bearing 96 is circumjacent the plate 84 and lies between it and the cover 44. A washer 98 is interposed between the lowermost disc and the bottom of the clutch cavity and is likewise splined to the shaft 66.

The above-described slip clutch is maintained in a preselected frictional state with the worm gear 62 operatively connected to the shaft 66 thereby, via the compressive pressure of the adjustable bolt 92. The bolt is readily accessible for adjustment by removing a threaded cap 101 from the top of housing cover 44. The amount of tightening torque applied to the bolt 92 is selected according to the amount of slip required in the clutch assembly 64 to protect the blade and circle mechanisms when the blade strikes an immovable object. Under normal operating conditions, however, the clutch assembly 64 maintains a driving connection between the worm gear 62 and the shaft 66. In this manner, when an immovable object is inadvertently struck by the blade 20, the blade and ring gear 15 will rotate relative to the frame 12 of the drawbar assembly without overstressing the circle gear teeth 16 nor the pinion 68. Selective adjustment of torque adjustment bolt 92 and clutch 64 allows the motor grader operator to easily adjust the mechanism to match his particular operating condition at any time. He can thus avoid circle gear, drive mechanism, blade and tire damage and still allow enough blade and circle movement after collision with an immovable object to keep his machine on a straight forward course.

The housing 32, 44 encloses the upper end of shaft 66, the clutch assembly 64, the worm 60, the worm gear 62, and the various associated elements best shown in FIG. 2. These elements are advantageously operated in an oil 103. For this purpose, an oil port is provided enclosed by plug 104 (see FIG. 2). When filling oil through the oil port, a vent plug 106 is removed. To help the flow of oil through the mechanism, plate 84 may have a plurality of passageways 107. As previously indicated, shaft 58 is sealed to the housing 32. Similarly, shaft 66 is sealed to the housing 32 as by seal 108. Suitable bearings 109–111 are provided as desired.

It is now deemed apparent that there has been described a drawbar assembly includes a safety mechanism and that the mechanism is readily adjustable and that the entire assembly is easily removable from the housing for further adjustability and/or repair.

While a preferred embodiment of the invention has herein been illustrated and described, this has been done by way of illustration and not limitation, and the invention should not be limited except as required by the scope of the appended claims.

What is claimed is:

1. In a drawbar assembly for use on a motor grader or the like including: a drawbar frame; a ring gear rotatably mounted on the frame; a blade; and means interconnecting the blade and the ring gear so that the blade revolves as the ring gear rotates; characterized by:

a rotatable shaft;

a pinion gear engaged with the ring gear and mounted on the shaft for rotation therewith;

drive means including a drive gear circumjacent the rotatable shaft for selectively rotating the shaft and hence rotating the ring gear;

a slip clutch mounted on the shaft and interposed between the drive gear and the rotatable shaft to allow relative movement between the shaft and drive gear when a preselected torque is exceeded, the slip clutch including a plurality of interleaved elements; and adjustment means associated with the slip clutch for changing the preselected torque and hence changing the force on the blade required to cause the relative movement, the adjustment means including a generally horizontal plate overlying the upper end of the shaft and having a downwardly-extending annular rib which overlies and operatively engages the interleaved elements for applying a compressive force on the interleaved elements; and the adjustment means including a fastener passing through the plate coaxial with the shaft and threadably engaging with the shaft.

2. The combination of claim 1 including a housing surrounding the upper end of the shaft, the slip clutch, and the drive gear; and the drive means also including a worm in the housing and having a driving connection to the drive gear; whereby the housing protects the housed parts.

3. The combination of claim 2 in which the housing contains an oil in which the interleaved elements are immersed.

4. The combination of claim 2 wherein the housing has a cap at its top and which is readily removable to provide access to the fastener, and the fastener has a head of a size smaller than the cap.

5. In a drawbar assembly for use on a motor grader or the like including: a drawbar frame; a ring gear rotatably mounted on the frame; a blade; and means interconnecting the blade and the ring gear so that the blade revolves as the ring gear rotates; characterized by:

a shaft mounted for rotation about a generally upright axis and having an axial, internally threaded hole at its upper end;

a pinion gear engaged with the ring gear and mounted at the lower end of the shaft for rotation therewith;

drive means including a worm adjacent the shaft for selectively rotating the shaft and hence rotating the ring gear;

a worm gear mounted circumjacent the shaft and independently rotatable relative thereto, and engaged with the worm to be driven thereby;

at least a portion of the worm gear being spaced from the shaft to therewith define a clutch chamber which is open at the top;

a slip clutch in the clutch chamber and including a plurality of annular, interleaved elements;

adjustment means for applying an adjustable compressive force on the interleaved elements and including a plate overlying the upper end of the shaft and having an opening aligned with said axial hole, an annular foot engaged with the uppermost element, and a threaded fastener passing through the opening and into said axial hole, said fastener having a head bearing against the plate, whereby the compressive force is selectively adjustable for changing the preselected torque which allows relative movement between the shaft and worm gear and hence changing the force on the blade required to cause the relative movement.

6. A drawbar assembly for use on a motor grader as set forth in claim 5 wherein the interleaved elements are, alternately, formed of metal and formed of paper having a high static friction level; and the metal elements are alternately splined to the shaft and the worm gear.

7. A drawbar assembly for use on a motor grader as set forth in claim 5 including a housing surrounding the upper end of the shaft, the slip clutch, the adjustment means, the worm gear, and the worm; the housing having a cap at its top which is removable to provide access to the head of the fastener to allow manipulation thereof.

8. In a drawbar assembly for use on a motor grader or the like including: a drawbar frame; a ring gear rotatably mounted on the frame; a blade; and means interconnecting the blade and the ring gear so that the blade revolves as the ring gear rotates; characterized by:

a rotatable shaft;

a pinion gear engaged with the ring gear and mounted on the shaft for rotation therewith;

drive means for selectively rotating the shaft and hence rotating the ring gear;

a slip clutch mounted on the shaft and interposed between the drive means and the shaft to allow relative movement between the shaft and drive means when a preselected torque is exceeded, and thereby permitting the blade to revolve about an upright axis;

a plate at one end of the shaft and operatively engaged with the slip clutch for applying a compressive force thereon; and a part operatively connected to the plate and adjustably engaged with the shaft for adjustably changing the compressive force and hence adjusting the preselected torque to change the force on the blade required to cause the relative movement.

9. The combination of claim 8 wherein the slip clutch includes a plurality of interleaved elements, and the plate is operatively engaged with one of those elements.

10. The combination of claim 8 including a housing on the drawbar frame and having an upper bore and a lower bore alignably disposed therethrough; said shaft extending through said lower bore and rotatably mounted therein; said slip clutch, said adjustment means, and at least a portion of said drive means providing a substantially upright assembly rotatably mounted with said shaft and detachably removable as a unit through said upper bore.

* * * * *